US008633004B1

(12) United States Patent
Rapp et al.

(10) Patent No.: US 8,633,004 B1
(45) Date of Patent: Jan. 21, 2014

(54) METHOD AND SYSTEM FOR HARVESTING HYDROTHERMAL ENERGY

(75) Inventors: John W. Rapp, Manassas, VA (US); Stephanie S. Groves, Aldie, VA (US); Nicholas J. Nagurny, Manassas, VA (US)

(73) Assignee: Lockheed Martin Corporation, Bethesda, MD (US)

( * ) Notice: Subject to any disclaimer, the term of this patent is extended or adjusted under 35 U.S.C. 154(b) by 220 days.

(21) Appl. No.: 13/088,728

(22) Filed: Apr. 18, 2011

Related U.S. Application Data

(60) Provisional application No. 61/326,915, filed on Apr. 22, 2010.

(51) Int. Cl.
*C12P 23/00* (2006.01)

(52) U.S. Cl.
USPC ..... 435/167; 114/314

(58) Field of Classification Search
USPC ..... 435/167; 114/314
See application file for complete search history.

(56) References Cited

U.S. PATENT DOCUMENTS

| | | | |
|---|---|---|---|
| 5,950,732 | A | 9/1999 | Agee et al. |
| 6,703,534 | B2 | 3/2004 | Waycuilis et al. |
| 7,546,880 | B2 | 6/2009 | Zhang et al. |
| 2005/0072301 | A1 | 4/2005 | Baciu |
| 2007/0056770 | A1 | 3/2007 | Fraser |
| 2008/0101999 | A1 | 5/2008 | Balczewski |
| 2008/0314043 | A1 | 12/2008 | Howard et al. |
| 2009/0217664 | A1 | 9/2009 | Rapp et al. |

FOREIGN PATENT DOCUMENTS

| | | | |
|---|---|---|---|
| EP | 1772202 | A1 | 4/2007 |
| GB | 2391881 | A | 2/2004 |
| JP | 2001280055 | A | 10/2001 |
| JP | 2003149150 | A | 5/2003 |
| JP | 2004321952 | A | 11/2004 |
| JP | 2005313800 | A | 11/2005 |
| JP | 2009119463 | A | 6/2009 |

OTHER PUBLICATIONS

Jones, W. M. jannaschi, An Extremely Thermophilic Methanogen from a Submarine Hydrothermal vent. Archivea of Microbiology. Springer-Verlag. 1983. vol. 136. pp. 254-261.*

Prado, Melissa R. et al.; "Toward the Efficient Production of Methane/Propane Double Hydrate"; Ind. Eng. Chem. Res., Apr. 30, 2009, 48 (11), pp. 5160-5164.

Max, Michael D., et al.; "Economic Geology of Natural Gas Hydrate"; "Chapter 4, Natural Gas Hydrate: A Diagenetic Economic Mineral Resource", p. 131-190; Coastal Systems and Continental Margins; vol. 9; Springer; Netherlands; 2006.

Schulz, H.D. et al.; "Marine Geochemistry"; Table of Contents; p. X1-XVIII; Chapters 3-5, pp. 75-206; Chapters 7-9, pp. 241-338; Chapter 11, pp. 371-428; Chapter 13, pp. 459-481; Berlin: Springer, 2006.

* cited by examiner

*Primary Examiner* — Susan Hanley
*Assistant Examiner* — Nghi Nguyen
(74) *Attorney, Agent, or Firm* — Howard IP Law Group, PC

(57) ABSTRACT

A method for extracting fuel gases from an underwater plume emitted from an underwater hydrothermal vent includes the step of collecting via an underwater fluid collector an underwater plume emitted from the hydrothermal vent. The underwater plume includes methane and hydrogen. The method further includes a step of directing a first fluid containing the underwater plume into a first inlet of a first underwater heat exchanger and a second fluid into a second inlet of the first underwater heat exchanger. The second fluid at the second inlet is at a temperature sufficiently lower than the temperature of the first fluid to transfer sufficient heat therebetween to form methane hydrate and hydrogen-methane hydrate in the first fluid. The method further includes the step of conveying the methane hydrate and hydrogen-methane hydrate to the surface of the water body via a duct connected to a first outlet of the first heat exchanger.

27 Claims, 10 Drawing Sheets

METHOD AND SYSTEM FOR HARVESTING HYDROTHERMAL ENERGY

CROSS-REFERENCE TO RELATED APPLICATION

The present application claims the benefit of the U.S. Provisional Patent Application Ser. No. 61/326,915, filed on Apr. 22, 2010, which application is incorporated by reference herein in its entirety.

FIELD OF INVENTION

The present invention relates generally to energy harvesting, and more particularly, to harvesting energy from hydrothermal energy resources.

BACKGROUND

Hydrothermal vents are fissures in the earth's surface from which geothermally heated water issues. Such hydrothermal vents are commonly found near volcanically active locations, areas associated with movement of tectonic plates and ocean basin hotspots. Plumes emanating from hydrothermal vents include minerals and gases such as hydrogen, methane, carbon dioxide and hydrogen sulfide. Since methane and carbon dioxide are known to be greenhouse gases, gases emitted from the hydrothermal vents are believed to contribute to greenhouse warming. Furthermore, the relatively high temperature of the water emitted from hydrothermal vents is conducive to formation of aquacultures including anaerobic microorganisms. Such anaerobic microorganisms consume carbon dioxide, as an energy source, from the seawater as well as that emitted by the hydrothermal vents and convert it into methane. Methane is the principal component of natural gas and its relative abundance enhances its attraction as an alternative fuel source.

"Economic Geology of Natural Gas Hydrate", M. D. Max et al. ("Max" hereafter) teaches that several kinds of pore holes in the sedimentary sea floor exist, including the hydrothermal vents. Chapter 4 of Max discusses the detailed working of hydrothermal vent mechanisms. FIG. 4.3 of Max shows a schematic of the sedimentary features for collisional continental margins. Different mechanisms are responsible for the release of methane from the sediment into the pore holes for Thermo-Genic (TG) and Bio-Genic (BG) pore holes. FIG. 4.4 of Max shows a schematic of the sedimentary features for a passive continental margin. The TG pore holes are commonly called hydrothermal vents. However, there are other conditions (for example, FIG. 3.21 of Max) that typically are more transient in nature where a subsiding seafloor can allow BG pore holes to form, thus releasing methane gas into the ocean.

As is known in the art, carbon dioxide and other gases stay dissolved in the relatively high temperature, high pressure water issuing from hydrothermal vents. Some gasses such as methane are not dissolved. As the relatively high temperature vent water comes in contact with the ambient (relatively cold) water surrounding the vents, the vent water is cooled. The cooling vent water causes methane and other gases to diffuse into the surrounding water. The diffusion of these gases makes it difficult to harvest these gases from the vent water.

"Marine Geochemistry" by Schultz, et. al, ("Schultz" hereafter) provides detailed descriptions of the minerals, and their chemistry, present in the sea floor sediments, which are leached out into the vent fluid and present in the plumes. For example, chapter 3 of Schultz discusses the dissolved constituents in marine pore water, chapter 4 of Schultz discusses the organic matter accumulation in sediments and organic geochemical processes, and chapter 5 of Schultz describes bacteria and marine biogeochemistry. Schultz also describes the reactivity of iron (chapter 7), the sulphate reduction (chapter 8), the carbonates (chapter 9), the availability of manganese (chapter 11) and hot vents and cold seeps (chapter 13) as applicable to the marine geology.

Systems and methods for harvesting gases and minerals from hydrothermal resources are desirable.

SUMMARY OF THE INVENTION

As described herein, a method for harvesting methane from the plumes released by hydrothermal vents provides an alternate source of fuel while also reducing the emission of such greenhouse gases in the environment. According to an embodiment of the invention, a method for extracting a gas from an underwater plume includes the step of receiving at a first inlet of a first underwater heat exchanger, a first fluid containing water and at least one gas capable of forming a clathrate hydrate. The method further includes a step of receiving at a second inlet of the first underwater heat exchanger, an ambient second fluid. The ambient second fluid is at a temperature sufficiently lower than the temperature of the first fluid to cause a transfer of sufficient heat therebetween to form a clathrate hydrate in the first fluid. The method further includes the step of discharging at a first outlet of the first underwater heat exchanger a slurry containing the clathrate hydrate.

According to an embodiment of the invention, a method for extracting fuel gases from a seawater plume emitted from an underwater hydrothermal vent includes the step of collecting via an underwater fluid collector a seawater plume emitted from the hydrothermal vent. The seawater plume includes at least methane and hydrogen. The method further includes the step of directing a first fluid containing the seawater plume into a first inlet of a first underwater heat exchanger and a second fluid into a second inlet of the first underwater heat exchanger. The second fluid is at a temperature sufficiently lower than the temperature of the first fluid to transfer sufficient heat between the first and second fluids to form at least one of methane hydrate and hydrogen-methane hydrate from the first fluid. The method also includes a step of conveying the at least one of methane hydrate and the hydrogen-methane hydrate to the surface of the water body via a duct connected to a first outlet of the first heat exchanger.

According to another embodiment of the invention, a method for generating methane hydrate using microorganisms includes a step of receiving a first fluid containing at least seawater and gases emitted by a hydrothermal vent, at an underwater bioreactor in the vicinity of a hydrothermal vent. The gases include one or more of hydrogen, methane and carbon dioxide. The bioreactor contains at least methanobacteria adapted to consume carbon dioxide and to release methane. The method further includes the steps of receiving the first fluid from the bioreactor at a first inlet of an underwater heat exchanger located substantially adjacent to the bioreactor and of directing ambient seawater into a second inlet of the heat exchanger. The ambient seawater is at a temperature sufficiently lower than the temperature of the first fluid, thereby causing the seawater to cool the first fluid sufficiently to cause the formation of at least one of methane hydrate and hydrogen-methane hydrate. The method further includes the step of conveying at least one of the methane hydrate and the hydrogen-methane hydrate through a duct connected to a first outlet of the first heat exchanger.

The method for generating methane hydrate may further include a bio-reactor containing sulfur reducing bacteria. The sulfur reducing bacteria consume hydrogen sulfide and release hydrogen and sulfur.

According to an embodiment of the invention, a system for harvesting gases from an underwater vent includes a plume collector positioned above a hydrothermal vent in a water body for collecting plumes emitted by the hydrothermal vent. The plumes contain at least one gas capable of forming a clathrate hydrate. The system further includes a first underwater heat exchanger in fluid communication with the plume collector positioned in general vicinity of the water body bed. The first underwater heat exchanger includes a first inlet configured to receive a first fluid containing the plumes collected by the plume collector and a second inlet configured to receive ambient water. The ambient water is at a temperature sufficiently lower than temperature of the first fluid to cause a transfer of heat therebetween to further cause formation of a clathrate hydrate in the first fluid. The first underwater heat exchanger further includes a first outlet for ejecting a slurry containing the clathrate hydrate and a second outlet for ejecting the water. The system includes a riser pipe for conveying the slurry containing clathrate hydrate to the surface of the water body.

According to an embodiment of the invention, a system for generating clathrate hydrate using microorganisms include a hydrogen-sulfide bioreactor configured to receive at least hydrogen sulfide from a hydrothermal vent and containing at least sulfur reducing bacteria for consuming hydrogen sulfide and releasing hydrogen and sulfur. The system further includes a carbon dioxide bioreactor configured to receive at least carbon dioxide from at least the hydrogen sulfide bioreactor and containing at least methanobacteria for consuming carbon dioxide and releasing methane. An underwater heat exchanger is in fluid communication with the carbon dioxide bioreactor for receiving a first fluid containing at least hydrogen, methane and brine. The underwater heat exchanger includes a first inlet configured to receive the first fluid and a second inlet configured to receive ambient water at a temperature sufficiently lower than a temperature of the first fluid to cause heat transfer therebetween, thereby causing formation of a clathrate hydrate in the first fluid. The underwater heat exchanger also includes a first outlet for ejecting a slurry containing the clathrate hydrate and a second outlet for ejecting the ambient water.

According to an embodiment of the invention, a method for sequestering carbon dioxide includes the steps of separating carbon dioxide from the exhaust gases of a gas turbine and carbonating a first fluid with separated carbon dioxide. The method further includes the steps of receiving at a first inlet of a heat exchanger the carbonated fluid and receiving a methane hydrate slurry at a second inlet of the heat exchanger. The methane hydrate slurry is at a temperature sufficiently lower than a temperature of the carbonated first fluid, thereby causing a transfer of heat from the carbonated first fluid to the methane hydrate slurry. The heat transfer causes the formation of carbon dioxide hydrate and the dissociating of the methane hydrate into methane and water. The method further includes the steps of discharging at a first outlet of the heat exchanger a slurry containing the carbon dioxide hydrate and conveying the slurry containing the carbon dioxide hydrate toward the bed of a water body.

BRIEF DESCRIPTION OF THE DRAWINGS

Understanding of the present invention will be facilitated by consideration of the following detailed description of the exemplary embodiments of the present invention taken in conjunction with the accompanying drawings, in which like numerals refer to like parts and in which.

DETAILED DESCRIPTION

Figure 1:
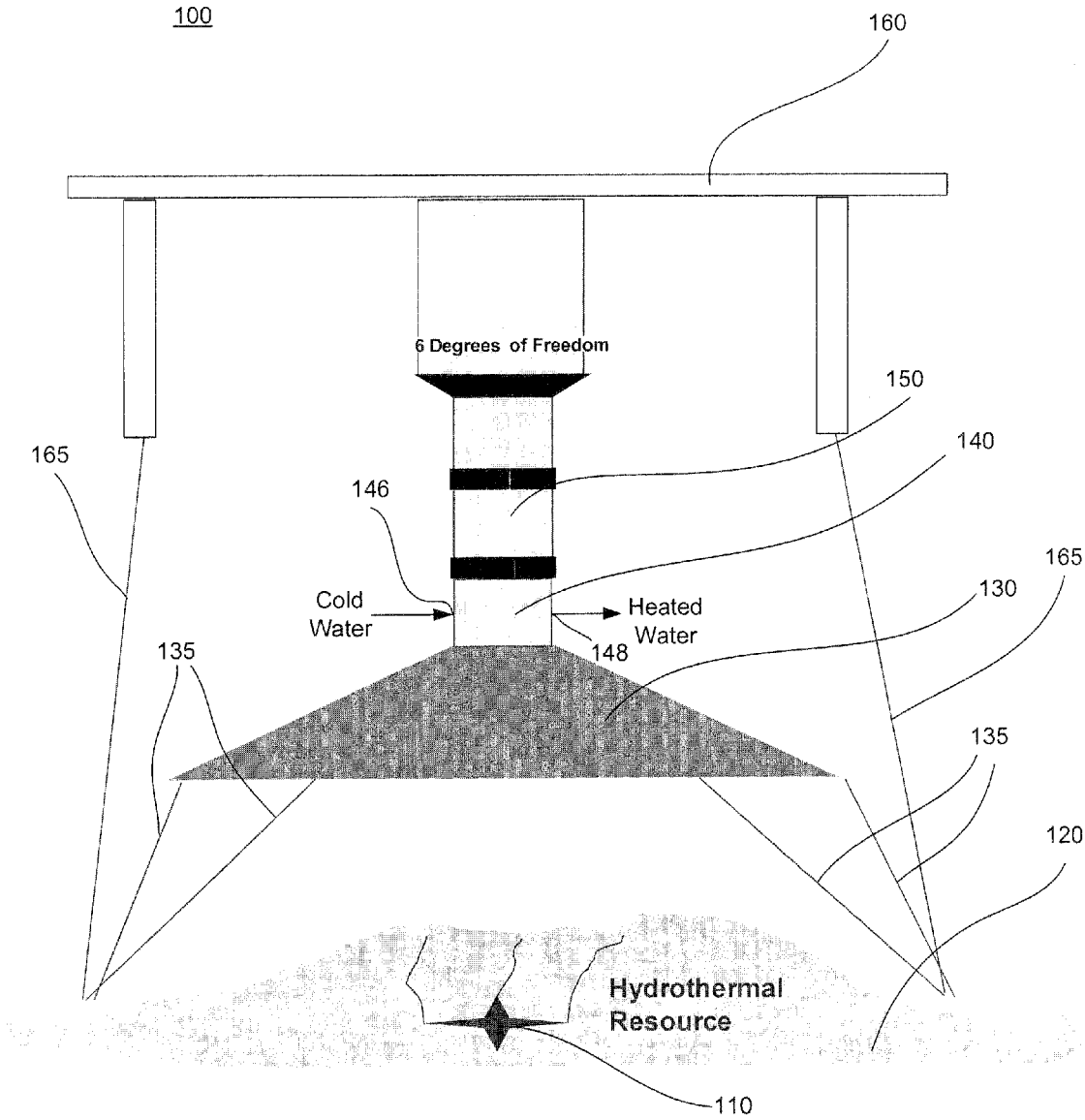
FIG. 1 is a schematic diagram of a system for harvesting hydrothermal energy, according to an embodiment of the invention.

It is to be understood that the figures and descriptions of the present invention have been simplified to illustrate elements that are relevant for a clear understanding of the present invention, while eliminating, for purposes of clarity, many other elements found in such underwater mineral and gas extraction systems. However, because such elements are well known in the art, and because they do not facilitate a better understanding of the present invention, a discussion of such elements is not provided herein. The disclosure herein is directed to all such variations and modifications known to those skilled in the art.

In the following detailed description, reference is made to the accompanying drawings that show, by way of illustration, specific embodiments in which the invention may be practiced. It is to be understood that the various embodiments of the invention, although different, are not necessarily mutually exclusive. Furthermore, a particular feature, structure, or characteristic described herein in connection with one embodiment may be implemented within other embodiments without departing from the scope of the invention. In addition, it is to be understood that the location or arrangement of individual elements within each disclosed embodiment may be modified without departing from the scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout several views.

One or more figures show block diagrams of systems and apparatus embodying aspects of the invention. One or more figures show flow diagrams illustrating systems and apparatus for such embodiments. Operational and process flows are described with references to the systems/apparatus shown in the accompanying drawings. However, it is to be understood that the operational and process flows described herein may be performed by embodiments of systems and apparatus other than those discussed with reference to the block diagrams, and embodiments discussed with reference to the systems/apparatus could perform operations different from those discussed with reference to the accompanying flow diagrams.

System for Harvesting Methane and Hydrogen

Referring to FIG. 1, a system 100 for harvesting at least methane and additionally hydrogen emitted from a hydrothermal vent 110 is schematically illustrated, according to an embodiment of the invention. The term "hydrothermal vent" is intended to include, but not limited to, TG pore holes, BG pore holes and any other fissures in an ocean or water body bed which may emit plumes. It is understood that the embodiments disclosed herein may also be used to collect methane gas from BG pore holes that are not of the hydrothermal subclass. In the illustrated embodiment, hydrothermal vent 110 is located in a bed 120 of a water body, for example, an ocean. System 100 includes a plume collector 130, a heat exchanger 140 in fluid communication with plume collector 130, a conduit 150 in fluid communication with heat exchanger 140, and a platform 160 coupled to conduit 150. It is understood that manifolds (not shown) may be included to allow multiple plume collectors 130 to be in fluid communication with heat exchanger 140, to allow multiple heat exchangers 140 to be in fluid communication with plume collector 130 and conduit 150, to allow multiple conduits 150 to be in fluid communication with one or more heat exchangers 140 and platform 160, or to allow multiple platforms 160 to be in fluid communication with one or more of conduits 150. It is understood that hydrothermal vents 110 may varyingly open in bed 120 over a given area. It is further understood that the extent of the plumes 113 (of FIG. 2) arising from vent 110 may vary according to various factors including but not limited to underwater currents, time and location of vent 110.

In one configuration, plume collector 130 has an inverted-funnel like configuration with the wide mouth of plume collector 130 facing one or more vents 110 and narrower outlet connected to heat exchanger 140. The mouth of plume collector 130 is sufficiently large to cover a wide area over which one or more vents 110 may open and emit plumes 113 (of FIG. 2) containing high temperature water, various gases and minerals and the surrounding aquaculture. Plume collector 130 is positioned above bed 120 at a height sufficient to cover a wide area over which one or more vents 110 open up or are likely to open up and emit plumes 113 (of FIG. 2). Furthermore, plume collector 130 is located sufficiently close to vent 110 to ameliorate the separation of gases from plumes 113 (of FIG. 2) and their subsequent diffusion in the surrounding water due to the cooling down of seawater or underwater plumes 113 (of FIG. 2). Plume collector 130 may be adapted to the extent and shape of the naturally occurring hydrothermal vent 110. In an exemplary configuration, the size of the mouth of plume collector 130 may be selected from a range of standard diameters from as small as 3 meters to cover a singular vent 110 of modest output, to diameters as large as 30 meters to cover a close collection of vents 110. In other configurations, plume collectors 130 may also be configured to extend over larger vent fields comprising a plurality of vents 110. In an exemplary embodiment, plume collector 130 may have an oval mouth. In other embodiments, plume collector 130 may have mouths of different geometrical shapes, depending on the requirements of a given application.

The extent of plume collector 130 may be selected based on the variation of the deep currents that naturally occur and pass over hydrothermal vent 110, as well as the seasons of interest for harvesting the methane and hydrogen from vent 110. The height of plume collector 130 mouth above hydrothermal vent 110 may also be adapted according to the temperature of plumes 113 (of FIG. 2), and the access required for the local biota to access the vent fluid. For instance, for plumes 113 (of FIG. 2) emitted at relatively high temperatures, plume collector 130 may be disposed at a greater height relative to vent 110 and for plumes 113 (of FIG. 2) emitted at a relatively low temperature, plume collector 130 may be disposed at a lower height relative to vent 110. It is understood that the height of plume collector 130 relative to vent 110 may also serve to protect plume collector 130 in case of high temperatures of plumes 113 (of FIG. 2). The height of plume collector 130 relative to vent 110 may also be adapted to the seafloor contour, and to variations of the deep currents. For examples, the faster the deep currents, the lower the plume collector 130 relative to vent 110 and the slower the deep currents, the higher the plume collector 130 relative to vent 110. In an exemplary embodiment, the height of plume collector 130 may be kept as small as one (1) meter for a singular vent 110 of modest output. In other embodiments, the height of plume collector 130 may extend up to ten (10) meters for a collection of vents 110 at varying depths. In an exemplary embodiment, plume collector 130 is anchored to bed 120 via one or more retention members 135.

It will be understood that plume collector 130 may be subjected to relatively high hydrostatic pressure depending on its depth. Furthermore, plume collector 130 is likely to be exposed to highly corrosive environment including seawater and high temperature plumes emitted from vent 110. Therefore, plume collector 130 may be manufactured from a material which is capable of withstanding high pressures and high temperatures as well as of resisting corrosive environments. Various metals, alloys and composite materials are known in the art which are capable of withstanding high temperatures of the plumes and high hydrostatic pressures encountered at the given depths as well as of resisting corrosive environments caused by a combination of the high temperature plumes containing various minerals and the ambient seawater. By way of non-limiting example, steel and/or other metals and composite materials used in high pressure steam boilers, for example, where temperatures reach 1,300-1,600 C or higher, and pressures of 100-200 bars, may be used in configuring plume collector 130.

Platform 160 is anchored to bed 120 via retention members 165. In one configuration, retention members 135, 165 may include cables and/or other high tensile strength structural members to ensure that collector 130 and platform 160 remain suspended above vent 110 generally in a predetermined location while being subjected to underwater currents and other such forces.

Underwater heat exchanger 140 is configured to be downstream of and in fluid communication with plume collector 130. In typical undersea environments where harvesting of hydrothermal energy is to take place, the ambient water in the vicinity of bed 120 (and hence hydrothermal vent 110) is generally at a relatively low temperature (i.e. relative to the temperature of the water in the plumes 113 (of FIG. 2) issuing from the vent), e.g., at about 4° Celsius at one thousand (1000) meters and deeper. The temperature of the ambient water in the vicinity of bed 120 may vary with the depth of bed 120 relative to the water surface. As is known in the art, plumes 113 (of FIG. 2) emitted from vent 110 are at a relatively high temperature, e.g., plumes 113 (of FIG. 2) emitted from commonly occurring small vents typically measure about 70° C., whereas plumes 113 (of FIG. 2) emitted from some larger vents have been measured over 300° C. Hydrothermal vents are also known to emit plumes 113 (of FIG. 2) at temperatures of about 120° C. as well as about 200° C.

Heat exchanger 140 is configured to receive the ambient (relatively cold) water from the surrounding sea water at a first inlet 146. Heat exchanger 140 is further configured to receive a fluid containing the relatively hot plumes collected by plume collector 130 at a second inlet thereof (not shown). The ambient water heated in the heat exchanger 140 is ejected at a first outlet 148. A chimney pipe (not shown) may be added to first outlet 148 to increase the flow of ambient water through heat exchanger 140. Due to the difference between the temperatures of the ambient water and the fluid containing the plumes, heat exchange occurs between the fluid and the ambient seawater in heat exchanger 140. Heat exchanger 140 facilitates the formation of methane hydrate from the plumes as the plumes are sufficiently cooled down by the ambient seawater that passes through heat exchanger 140. In an exemplary embodiment, heat exchanger 140 may be of a modular construction, such that several standard modules may be structurally integrated to adjust for the specific temperature and plume flow from hydrothermal vent 110. In one configuration, one or more pre-designed heat exchanger 140 modules may be fitted together depending on the plume temperature and flow of a given vent 110. In other embodiments, a single custom heat exchanger 140 may be designed for the specific temperature and flow of the hydrothermal vent 110. Since such heat exchanger design practices are known in the art and, therefore, are not described in further detail for the sake of brevity.

In one configuration, heat exchanger 140 is located at a depth of about 600 feet from the surface of the water body. It will be understood that heat exchanger 140 may be located at other depths, depending on the particular application and the corresponding environment. In an ocean environment, at depths of 600 feet or more, hydrostatic pressure of the water body is sufficient to induce the formation of methane hydrate in the fluid containing the plumes. However, if the heat exchanger 140 is located at a depth less than about 600 feet, additional means for pressurizing the fluid containing the plumes to form methane hydrate may be included. Such pressurizing means are known in the art and, therefore, not described in further detail for the sake of brevity.

In any event, as plumes 113 are collected by collector 130 and passed through the heat exchanger 140, a slurry is formed (from cooled plumes 113) containing at least the methane hydrate. Conduit 150 is arranged between the heat exchanger 140 and the surface platform 160 and adapted to convey the slurry from the heat exchanger toward the platform at the ocean surface. The slurry rises through conduit 150 due to increased buoyancy of the hydrates. As is known in the art, methane hydrate on average has a density around 0.9 g/cm$^3$. Since pure water is 1.0 g/cm$^3$ and seawater is on average 1.035 g/cm$^3$, the weight of the methane hydrate is less than an equal volume of water that it displaces and therefore, the slurry containing methane hydrate rises through conduit 150 which is surrounded by the seawater. The slurry received at the platform 160 is then extracted from the conduit and dispatched for further processing. In one configuration, the methane hydrate may be separated from the slurry and transported to the shore. An advantage of transporting methane hydrate is that one (1) liter of methane clathrate contains approximately 168 liters of methane gas at atmospheric pressure. In another configuration, methane may be extracted from the methane hydrate on platform 160 and may be used, for example, as a source of fuel for powering a generator located on or near platform 160.

Figure 2:
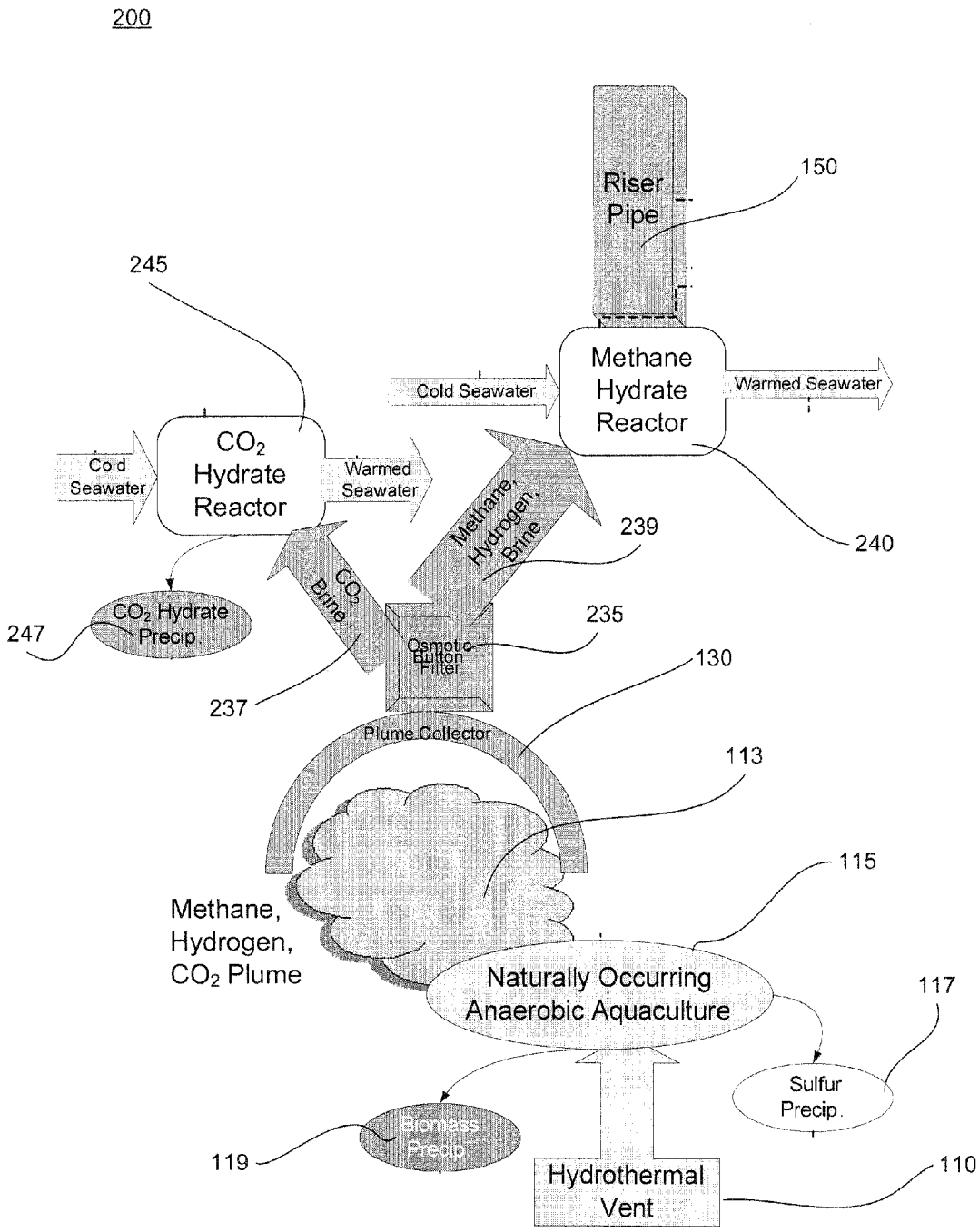
FIG. 2 is a schematic block diagram showing flow of operation in accordance with the system of FIG. 1.

Referring now to FIG. 2, in conjunction with FIG. 1, there is shown in schematic form a system 200 for harvesting methane hydrate and sequestering carbon dioxide from hydrothermal vent 110. Plumes 113 emitted from vent 110 generally include, but not limited to, methane, hydrogen, carbon dioxide and hydrogen sulfide gases and minerals such as copper, iron, zinc, sulfur and manganese and their compounds with oxygen, hydrogen and sulfur. It is understood that, although the following description of the system and method refers specifically to harvesting methane and hydrogen, the systems and the methods described herein may be suitably modified to extract other minerals and/or compounds present in plumes 113, without departing from the scope of the invention.

As is known in the art, naturally occurring anaerobic aquacultures 115 surround hydrothermal vent 110. Aquacultures 115 include, by way of non-limiting examples only, anaerobic microorganisms such as methanobacteria (sometimes called methanogens) and sulfur reducing bacteria. The microorganisms in aquacultures 115 are sustained by the nutrient rich water issuing out of hydrothermal vent 110. The methanobacteria in aquaculture 115, for example, consume carbon dioxide from plumes 113 as well as from ambient water and release methane. Thus, aquacultures 115 may be additional sources of methane, apart from vent 110. Further details regarding the naturally occurring anaerobic aquacultures may be found, for example, in chapter 5 of Schultz.

Aquacultures 115 may also contain sulfur reducing bacteria. The sulfur reducing bacteria consume hydrogen sulfide ($H_2S$) and release hydrogen and sulfur precipitate. Thus, aquacultures 115 may be additional sources of hydrogen, apart from vent 110. The microorganisms in aquacultures 115 also produce biomass precipitate, which, in turn, sustains aquacultures 115.

System for Sequestering Carbon Dioxide

As shown in FIG. 2, osmotic filter 235 is in fluid communication with plume collector 130. Plumes 113 emanating from vent 110, may be directed to osmotic filter 235 via plume collector 130. In one embodiment, osmotic filter 235 is configured to generate at least two streams from plumes 113: effluent stream 237 containing brine and carbon dioxide and stream 239 containing brine, methane and hydrogen. Stream 239 containing brine, methane and hydrogen may be directed to reactor 240 for forming at least one of methane hydrate and hydrogen-methane hydrate therefrom. Likewise, effluent stream 237 containing brine and carbon dioxide may be directed to reactor 245 for forming carbon dioxide hydrates 247 (of FIG. 2) therefrom. The methane hydrate and/or hydrogen-methane hydrates formed in reactor 240 may be conveyed to the surface of the water body via conduit 150 (e.g. a "riser pipe"). As is known in the art, carbon dioxide hydrate is denser than sea water. Therefore, carbon dioxide hydrates 247 (of FIG. 2) formed in reactor 245, when released into the surrounding water, tend to sink in the water and deposit onto bed 120. The low temperature water in the vicinity of bed 120 ensures that the deposits of carbon dioxide hydrates 247 (of FIG. 2) on bed 120 do not melt, thereby sequestering carbon dioxide in the form of the hydrates at the bottom of the water body along the seafloor margin.

Heat Exchanger Systems: Methane Hydrate Reactor

Figure 4:
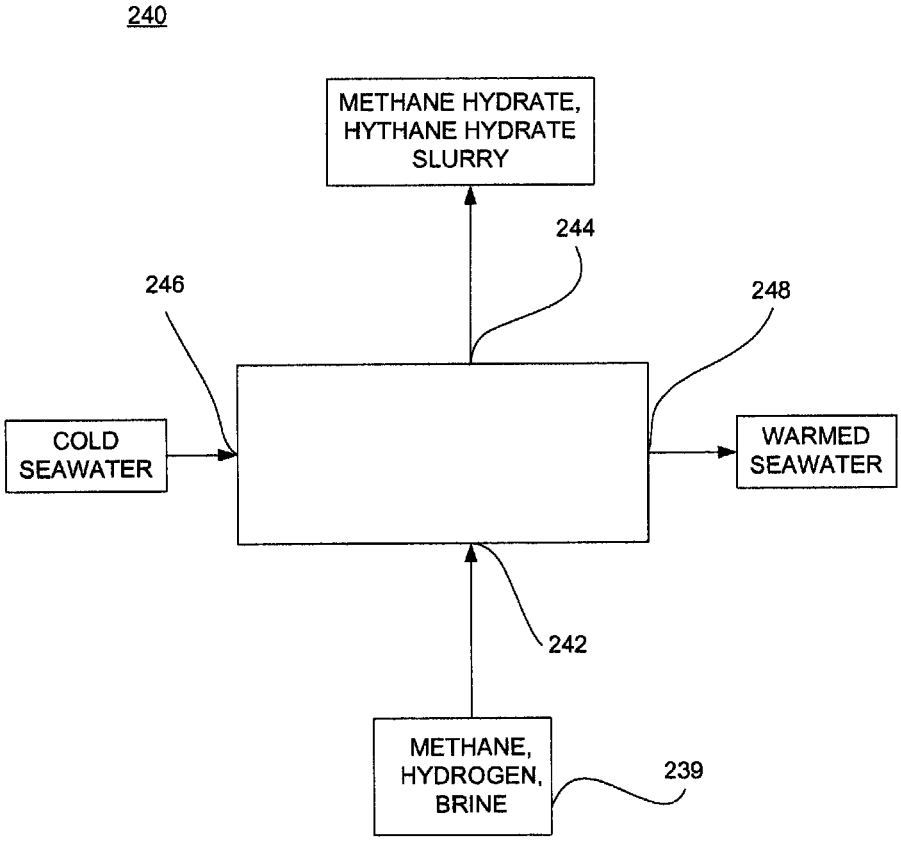
FIG. 4 is a schematic representation of the methane hydrate reactor of FIG. 2, according to an embodiment of the invention.

Referring now to FIG. 4, there is provided a schematic illustration of operational components of the methane hydrate reactor 240 of FIG. 2. In one configuration, reactor 240 takes the form of an underwater heat exchanger having a first inlet 242 configured to receive stream 239 containing at least methane and brine (or more likely hydrogen, methane and brine) from osmotic filter 235 (FIG. 2). A second inlet 246 is configured to receive relatively cold ambient water. The heat exchanger further includes a first outlet 244 for conveying a slurry of at least one of methane hydrate and hydrogen-methane hydrate formed as part of the heat exchanger cooling process. A second outlet 248 is configured to expel the seawater warmed during the heat exchange cycle. A chimney pipe (not shown) may be added to second outlet 248 to increase the flow of ambient water through reactor 240.

First inlet 242 and first outlet 244 may be in fluid communication via a first duct (not shown). Likewise, second inlet 246 and second outlet 248 may be in fluid communication via a second duct (not shown). Reactor 240 facilitates heat exchange between stream 239 and the relatively cold ambient seawater while preventing mixing of the two streams. The first and second ducts may be in thermal communication with each other, thereby facilitating heat exchange between stream 239 and the cold ambient seawater. The relatively cold ambient seawater is at a temperature lower than the temperature of stream 239. Particularly, the relatively cold ambient seawater may be at a temperature lower than the freezing temperature of methane hydrate, thereby facilitating the formation of methane hydrate in stream 239. As is known in the art, the formation of methane hydrate is a slow process; the flow rate of the relatively cold ambient seawater through the second duct (not shown) may be adjusted accordingly.

The exposure of methane hydrate formed in reactor 240 to the hydrogen gas present in the stream 239 may further lead to formation of hydrogen-methane hydrate, i.e., a double hydrate of methane and hydrogen. As is known the art, the hydrogen molecules become trapped in the small cages that naturally form in-between when several methane hydrate cages join together. This small amount of captured hydrogen does not significantly increase the density or reduce the buoyancy of the methane hydrate. It is further known in the art that a given quantity of hydrogen-methane mixture, by way of non-limiting example, comprising about 30% hydrogen and about 70% methane, provides for combustion at least a similar or a greater amount of thermal energy as that provided by a comparable quantity of methane, while producing only about one half the amount of carbon dioxide. It is understood that that the term hydrogen-methane mixture is intended to include mixtures comprising other proportions of hydrogen and methane as well. This may make hydrogen-methane hydrate more ecologically attractive than methane hydrate, and ultimately more valuable. Thus, an advantage of the system according to the present invention is the production of slurry containing hydrogen-methane hydrate in reactor 240. The hydrogen-methane hydrate slurry may be processed on-platform or off-platform to obtain hydrogen-methane.

In an exemplary embodiment, the cold ambient seawater water received via second inlet 246 may be pumped from a location sufficiently separate from vent 110 (due to the possibility that the water in the vicinity of vent 110 is already heated via emanating plumes to a high temperature). System 200 (of FIG. 2) may further include additional pumping systems to pump the cold ambient water for input to the heat exchanger. Details for such pumping systems are well known and hence are not described further, for purposes of brevity.

The formation of methane hydrate and/or hydrogen-methane hydrate within stream 239 may be further expedited by application of hydrophobic coatings on the inner surfaces of the first duct through which stream 239 is flowing within reactor 240. In one configuration, such hydrophobic coatings may take the form of hydrophobic oleic acid films. As is known in the art, a hydrophobic coating repels water molecules and at the low temperature and the high pressure in reactor 240, therefore, may expedite the cage formation of water molecules about methane and hydrogen molecules to form methane hydrate, hydrogen hydrate and/or hydrogen-methane hydrate. The hydrophobic coatings also serve to repel the hydrates, thereby preventing the hydrates from adhering to the first duct. A slurry containing at least methane hydrate is formed in the first duct (not shown) in reactor 240 from the brine. The slurry along with methane hydrate may be directed to conduit 150 via first outlet 244. The slurry may also contain hydrogen hydrate and hydrogen-methane hydrate or other gas hydrates. The warmed seawater is ejected out of reactor 240 via second outlet 248.

Heat Exchanger Systems: Carbon Dioxide Reactor

Figure 5:
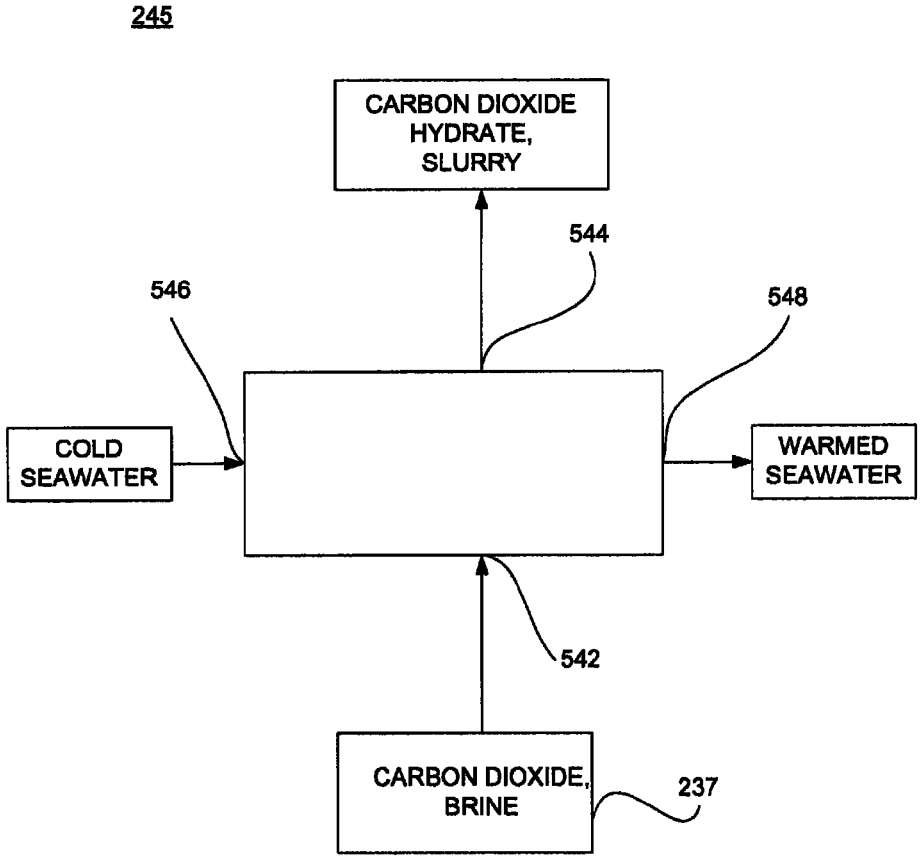
FIG. 5 is a schematic representation of the carbon dioxide hydrate reactor of FIG. 2, according to an embodiment of the invention.

Referring now to FIG. 5, carbon dioxide hydrate reactor 245 is schematically illustrated. In one configuration, reactor 245 takes the form of an underwater heat exchanger having a first inlet 542 and a first outlet 544 and a second inlet 546 and a second outlet 548. In an exemplary embodiment, first inlet 542 and first outlet 544 may be in fluid communication via a third duct (not shown). Likewise, in an exemplary embodiment, second inlet 546 and second outlet 548 may be in fluid communication via a fourth duct (not shown). First inlet 542 is configured to receive effluent stream 237 containing at least carbon dioxide and brine from osmotic filter 235. Second inlet 546 is configured to receive relatively cold ambient water. In an exemplary embodiment, cold ambient water may be pumped from a location distant from vent 110 because the water in the vicinity of vent 110 may be heated by the water issuing from vent 110. System 200 (of FIG. 2) may further include additional pumping system to pump the cold ambient water. Further details for such pumping system are not provided for the sake of brevity.

Reactor 245 facilitates heat exchange between stream 237 and the relatively cold ambient seawater while preventing mixing of the two streams. By way of non-limiting example only, stream 237 may be conveyed via the third duct (not shown) while the cold ambient seawater may be conveyed via the fourth duct (not shown). The third and fourth ducts may be in thermal communication with each other, thereby facilitating heat exchange between stream 237 and the cold ambient seawater. The relatively cold ambient seawater is at a temperature lower than the temperature of stream 237. Particularly, the relatively cold ambient seawater may be at a temperature lower than the freezing temperature of carbon dioxide hydrate, thereby facilitating the formation of carbon dioxide hydrate in stream 237 flowing through the third duct.

Formation of carbon dioxide hydrate within stream 237 may be enhanced by application of hydrophobic coatings on the inner surfaces of the third duct through which stream 237 is flowing within reactor 245. In one configuration, such hydrophobic coatings may take the form of oleic acid films. As is known in the art, a hydrophobic coating repels water and at the low temperature and the high pressure in reactor 245, and, therefore, may expedite the cage formation of water molecules about carbon dioxide molecules to form carbon dioxide hydrate. The hydrophobic coatings also serve to repel the hydrates, thereby preventing the hydrates from adhering to the third duct. A slurry containing at least carbon dioxide hydrate is formed in the third duct (not shown) in reactor 245 from the brine. In an exemplary embodiment, the slurry along with carbon dioxide hydrate may be discharged into the sea via first outlet 544. The warmed seawater is ejected out of reactor 245 via second outlet 548. One of ordinary skill in the art will appreciate that the carbon dioxide hydrates discharged from reactor 245 may be quantified via known methods. Further, it will be appreciated that carbon dioxide hydrates, being denser than the ambient water, tend to sink to bed 120. The relatively low temperatures of the water in the vicinity of bed 120 are likely to preserve carbon dioxide hydrates in their frozen form, thereby preventing the release of carbon dioxide gases therefrom into the water and the environment. Over time, these deposited carbon dioxide hydrates will become buried in sediment, further entrapping the carbon dioxide.

Bioreactor System for Generating Methane and Carbon Dioxide

Figure 6:
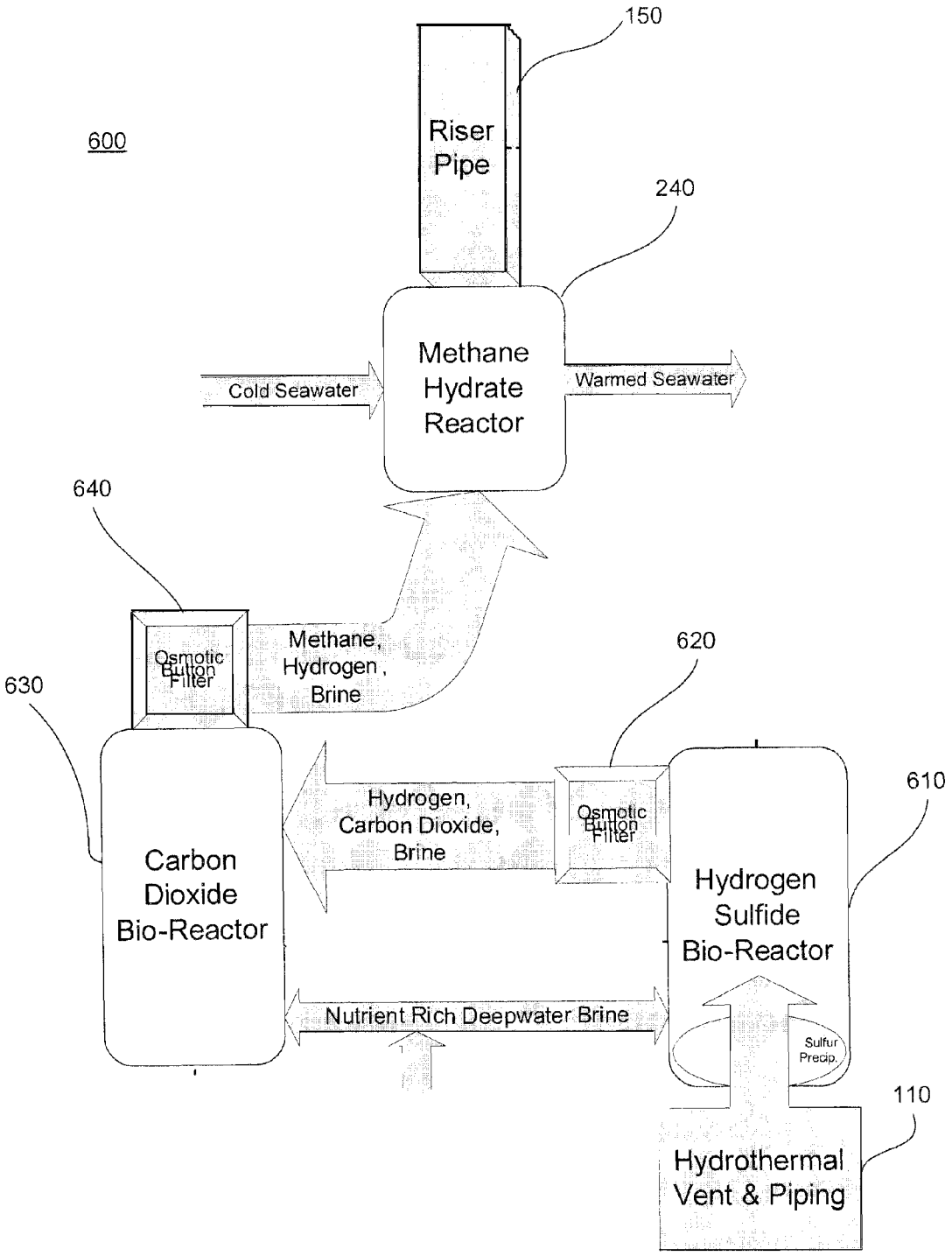
FIG. 6 is a schematic representation of a system for harvesting at least methane and hydrogen using bioreactors, according to another embodiment of the invention.

Referring now to FIG. 6, a system 600 for harvesting at least methane and hydrogen and sequestering carbon dioxide is illustrated, according to another embodiment of the invention. System 600 includes a hydrogen sulfide bio-reactor 610, a first osmotic filter 620, a carbon dioxide bio-reactor 630, a second osmotic filter 640, a methane hydrate reactor 240 and a conduit 150. In the embodiment illustrated in FIG. 2, plumes issuing from vent 110 are collected via collector 130 to extract at least methane, hydrogen, and carbon dioxide, whereas in the embodiment illustrated in FIG. 6, bio-reactors 610, 630 having selected micro-organisms are used to produce at least hydrogen and methane. The microorganisms for bio-reactors 610, 630 are fed nutrient rich brine issuing from vent 110. Thus, bio-reactors 610, 630 may be used to either supplant or supplement the role of the naturally occurring aquacultures surrounding the hydrothermal vents and may also eliminate the need for plume collector 130.

The microorganisms in bio-reactor 610 may include sulfur reducing bacteria, which consume hydrogen sulfide issuing from vent 110 and release hydrogen and sulfur precipitates. In one configuration, the sulfur precipitates generated in bio-reactor 610 may be used to support the naturally occurring aquacultures surrounding vent 110. An advantage of using bio-reactor 610 is that hydrogen sulfide, which is a known toxic gas, may be consumed to release hydrogen which may be used as a fuel gas. Thus, bio-reactor 610 advantageously neutralizes a toxic gas such as hydrogen sulfide while simultaneously producing a valuable fuel gas such as hydrogen. Likewise, the microorganisms in bio-reactor 630 may include Methanobacteria (methanogens), which consume carbon dioxide and release methane. Thus, bio-reactor 630 advantageously consumes carbon dioxide, a known greenhouse gas, and produces a valuable fuel gas such as methane. In an exemplary embodiment, Methanobacteria (methanogens) may be selected to function at elevated temperatures of about 70° C. In one configuration, Methanobacteria (methanogens) may be selected from the naturally occurring aquacultures surrounding vent 110.

Bioreactors 610 and 630 may be configured to produce different proportions of methane and hydrogen. In one exemplary configuration, bioreactors 610 and 630 may be configured to produce 100% methane by consuming hydrogen sulfide and carbon dioxide. An exemplary mass and energy balance for producing 100% methane is illustrated in Table 1 below.

TABLE 1

Equivalent Mass and Energy Balance for the Bioreactors producing 100% Methane

| Chemical Reaction | Enthalpy Change | Enthalpy Units | Balancing Factor | Energy Balance | Notes |
|---|---|---|---|---|---|
| $H_2S \rightarrow \frac{1}{2} S_2 + H_2$ | 41.3 | kJ/mol (Gas) | 4 | 165.2 | Sulfur Reducing Bacteria-Endothermic |
| $CO_2 \rightarrow C + O_2$ | 393.5 | kJ/mol (Gas) | 1 | 393.5 | Methanogens-Endothermic |
| $\frac{1}{2} O_2 + H_2 \rightarrow H_2O$ | −241.8 | kJ/mol (Gas) | 2 | −483.6 | Exothermic |
| $C + 2H_2 \rightarrow CH_4$ | −74.9 | kJ/mol (Gas) | 1 | −74.9 | Exothermic |
| | | | | −165 | Net Methanogen Energy-Exothermic |
| | | | | 0.4 | Net Bioculture Energy-Neutral |

Table Note: For production of pure methane, every four Hydrogen Sulfide molecules going into the bioreactor system generates one Methane molecule.

As can be discerned from Table 1, for production of 100% methane, one methane molecule may be generated by the consumption of four (4) molecules of Hydrogen Sulfide.

In another configuration, bioreactors 610, 630 may be configured to produce 70% methane and 30% hydrogen. An exemplary mass and energy balance for producing 70% methane and 30% hydrogen is illustrated in Table 2 below.

TABLE 2

Equivalent Mass and Energy Balance for the Bioreactors producing 70% Methane and 30% Hydrogen

| Chemical Reaction | Enthalpy Change | Enthalpy Units | Balancing Factor | Energy Balance | Notes |
|---|---|---|---|---|---|
| $H_2S \rightarrow \frac{1}{2} S_2 + H_2$ | 41.3 | kJ/mol (Gas) | 3 + 28 = 31 | 1280.3 | Sulfur Reducing Bacteria-producing 3 extra Hydrogen Molecules |
| $CO_2 \rightarrow C + O_2$ | 393.5 | kJ/mol (Gas) | 7 | 2754.5 | Methanogens |
| $\frac{1}{2} O_2 + H2 \rightarrow H_2O$ | −241.8 | kJ/mol (Gas) | 14 | −3385.2 | |

TABLE 2-continued

| Equivalent Mass and Energy Balance for the Bioreactors producing 70% Methane and 30% Hydrogen | | | | | |
|---|---|---|---|---|---|
| Chemical Reaction | Enthalpy Change | Enthalpy Units | Balancing Factor | Energy Balance | Notes |
| $C + 2H_2 \rightarrow CH_4$ | −74.9 | kJ/mol (Gas) | 7 | −524.3 | |
| | | | | −1155 | Net Methanogen Energy-Exothermic |
| | | | | 125.3 | Net Bioculture Energy-Slightly Endothermic |

Table Note: For production of 70% Methane and 30% Hydrogen, every thirty-one Hydrogen Sulfide molecules going into the bioreactor system generates seven Methane molecules and three Hydrogen molecules.

As can be discerned from Table 2 above, seven molecules of methane and three molecules of hydrogen may be generated by the consumption of thirty-one (31) molecules of hydrogen sulfide. It will be appreciated that other proportions of methane and hydrogen may be generated by using different mass and energy balance configurations depending on the requirements of a given application.

Still referring to FIG. 6, osmotic filter 620 directs a stream containing hydrogen, carbon dioxide and brine from bio-reactor 610 to bio-reactor 630 while confining the sulfur reducing bacteria to bioreactor 610. Osmotic filter 620 also prevents the hydrogen-sulfide present in bio-reactor 610 from reaching bio-reactor 630, because some methanogens are susceptible to poisoning by hydrogen-sulfide. Osmotic filter 640 directs a stream containing methane, hydrogen and brine from bio-reactor 630 to methane hydrate reactor 240, while confining the methanogens to bioreactor 630. It is to be understood that reactor 240 is referred to as methane hydrate reactor only for the sake of simplicity and is not limited to producing methane hydrates only. Reactor 240 may additionally produce hydrogen hydrates, hydrogen-methane hydrates, or other gas hydrates. The hydrates produced in reactor 240 may be directed to conduit 150, which, in turn, conveys the hydrates to the platform surface on the water body for further processing.

Methods for Harvesting Methane and Hydrogen

Figure 7:
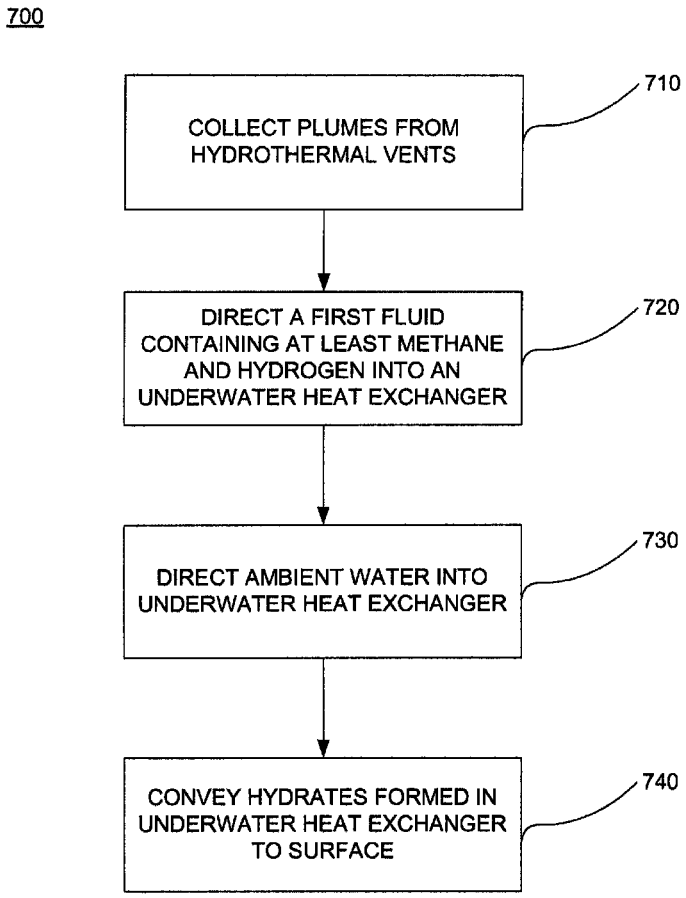
FIG. 7 is a process flow for harvesting methane and hydrogen issuing from hydrothermal vents, according to an embodiment of the invention.

Referring now to FIG. 7, in conjunction with FIGS. 1 and 4, there is shown a process flow 700 for harvesting at least methane and hydrogen issuing from hydrothermal vents. At step 710, plumes issuing from hydrothermal vents 110 (of FIG. 1) are collected using, for example, a plume collector 130 (see FIG. 1). At step 720, fluid collected from the heated plumes containing at least methane, hydrogen, and brine is directed from the collector 130 to a first inlet 242 (see FIG. 4) of reactor 240 (see FIGS. 1, 4). A second fluid in the form of ambient water is directed to a second inlet 246 (see FIG. 4) of reactor 240 at step 730. The ambient water is at a sufficiently low temperature to extract heat from the first fluid. Preferably, the ambient water is at a temperature lower than the freezing point of methane hydrate. The extraction or transfer of heat from the first fluid leads to formation of at least methane hydrate in reactor 240.

Additionally, hydrogen hydrates and hydrogen-methane hydrates may also be formed in reactor 240. At step 740, the hydrates formed in reactor 240 may be conveyed to the surface of the water body via a conduit for further processing. In one configuration, the hydrates may be transported to an on-shore facility for extraction of valuable fuel gases such as methane, hydrogen and hydrogen-methane from the respective hydrates. In another configuration, the hydrates may be melted off-shore to extract the fuel gases, which may be used to produce power off-shore.

Figure 8:
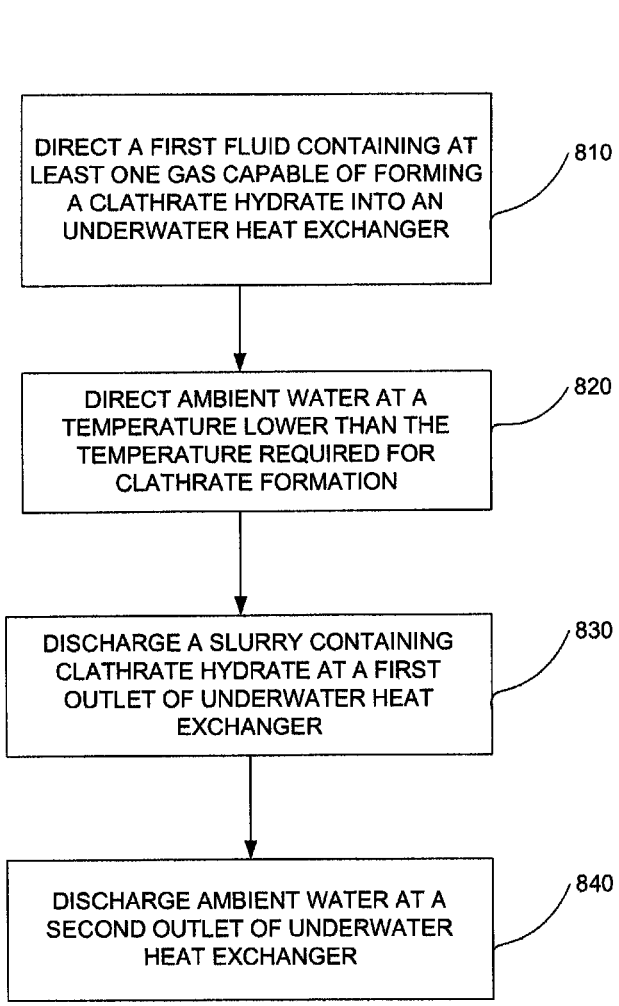
FIG. 8 is a process flow for forming a clathrate hydrate using relatively cold ambient seawater, according to an embodiment of the invention.

Now referring to FIG. 8, in conjunction with FIGS. 1, 4 and 5, there is shown a process flow 800 for harvesting at a gas capable of forming a clathrate hydrate and issuing underwater, for example, from hydrothermal vents. At block 810, a first fluid containing at least one gas capable of forming a clathrate hydrate is directed to a first inlet (242 of FIG. 4 or 542 of FIG. 5) of an underwater reactor (240 of FIG. 4 or 245 of FIG. 5). The first fluid may contain brine and at least one gas such as methane, hydrogen or carbon dioxide, which is capable of forming a clathrate hydrate. At block 820, ambient water is directed at a second inlet (246 of FIG. 4 or 546 of FIG. 5). The ambient water is at a temperature lower than a temperature required for clathrate hydrate formation, such as a freezing temperature of methane hydrate or carbon dioxide hydrate. The temperature of the ambient water entering the underwater heat exchanger is also lower than the temperature of the first fluid to facilitate a transfer of heat from the first fluid to the ambient seawater. At block 830, a slurry containing a clathrate hydrate is discharged at a first outlet (244 of FIG. 4 or 544 of FIG. 5), wherein the clathrate hydrate formation is caused by the transfer of heat from the first fluid to the ambient water. At block 840, the ambient water is discharged at a second outlet (248 of FIG. 4 or 548 of FIG. 5).

Power Generation for Operation of Surface Systems on Platform 160

Figure 3:
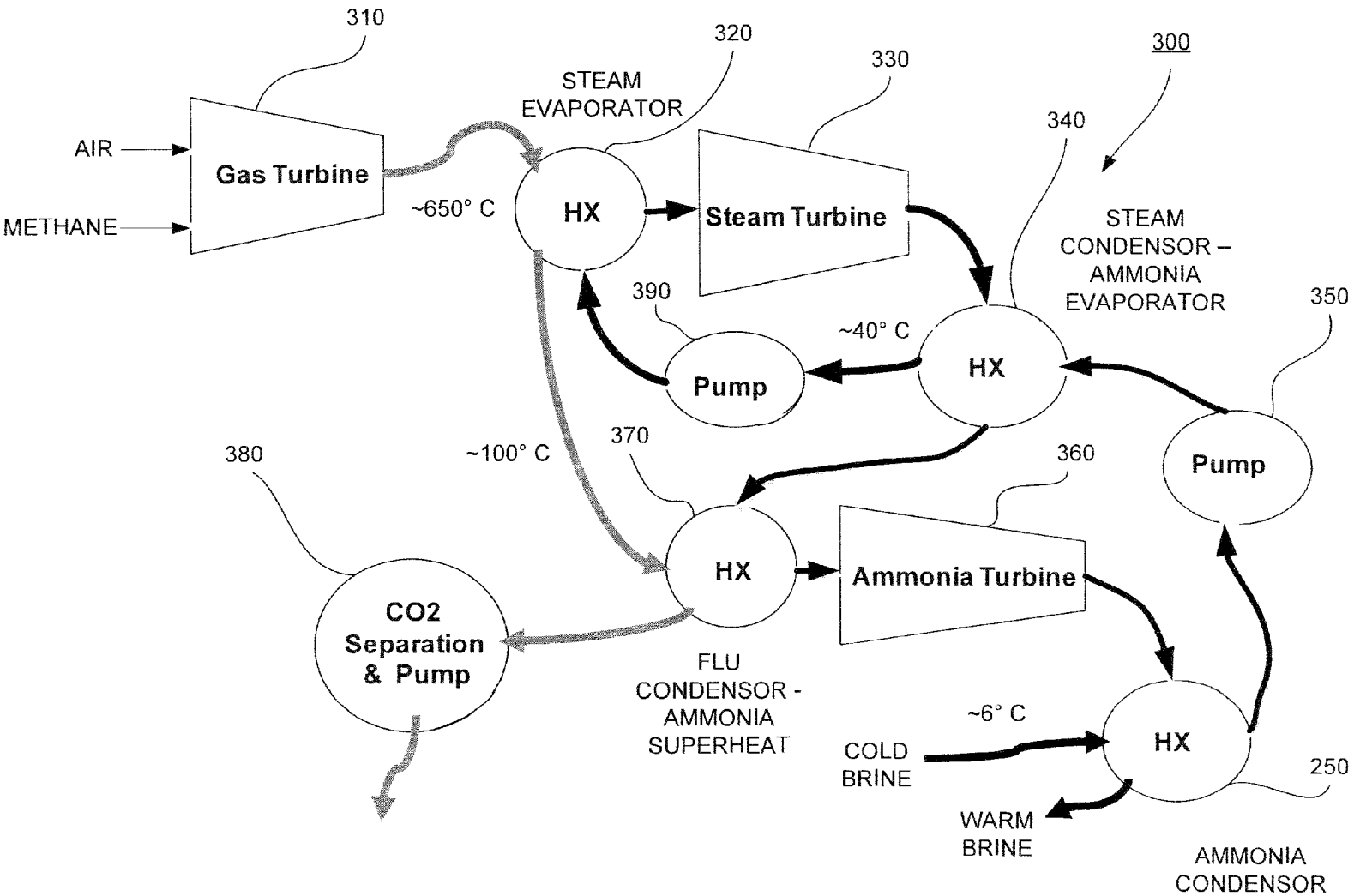
FIG. 3 is a schematic representation of the thermodynamic cycle useful in the system of FIG. 1.

Referring now to FIG. 3, a system 300 for generation of power required for the operation of surface systems on platform 160 is schematically illustrated, according to an exemplary embodiment of the invention. In the illustrated configuration, system 300 includes a gas turbine 310, a steam turbine 330 and an ammonia turbine 360 to generate power sufficient to fulfill the power requirements of the surface systems on platform 160. In an exemplary embodiment, a small quantity of methane and/or hydrogen-methane may be extracted from the methane hydrate or hydrogen-methane hydrate conveyed to the surface by conduit 150 to operate gas turbine 310. Heat energy from the exhaust gases of gas turbine 310 may be advantageously extracted in a heat exchanger or evaporator 320 to generate steam to operate steam turbine 330.

Likewise, heat energy from the steam exiting steam turbine 330 may be advantageously extracted in a heat exchanger or ammonia evaporator 340 to operate ammonia turbine 360. In particular, ammonia exiting a pump 350 may be evaporated in heat exchanger or ammonia evaporator 340. Exhaust gases from gas turbine 310 may be further directed to a heat exchanger or ammonia superheater 370 to superheat ammonia entering ammonia turbine 360. The cold brine conveyed to the surface along with the hydrates via conduit 150 may be used in a heat exchanger or ammonia condenser 250 to condense ammonia exiting ammonia turbine 360 and pumped by pump 350 to heat exchanger 340. Thus, apart from consuming only a small quantity of methane to generate power, the cold brine lifted to the surface may be advantageously used to generate additional power by operating ammonia turbine 360.

In an exemplary embodiment, system 300 may further include a heat exchanger (not shown) disposed between pump 350 and heat exchanger 340. The warm surface water may be directed to the heat exchanger (not shown) to preheat ammonia before the ammonia enters heat exchanger 340.

For those knowledgeable in the art of submerged vessel design, system 300 for generation of power may be adapted for required operation of a submersible platform fitted with snorkel tubes, pressure hulls, and ballast tanks in place of platform 160.

Reducing Carbon Dioxide Emission from Power Generation System

Figure 9:
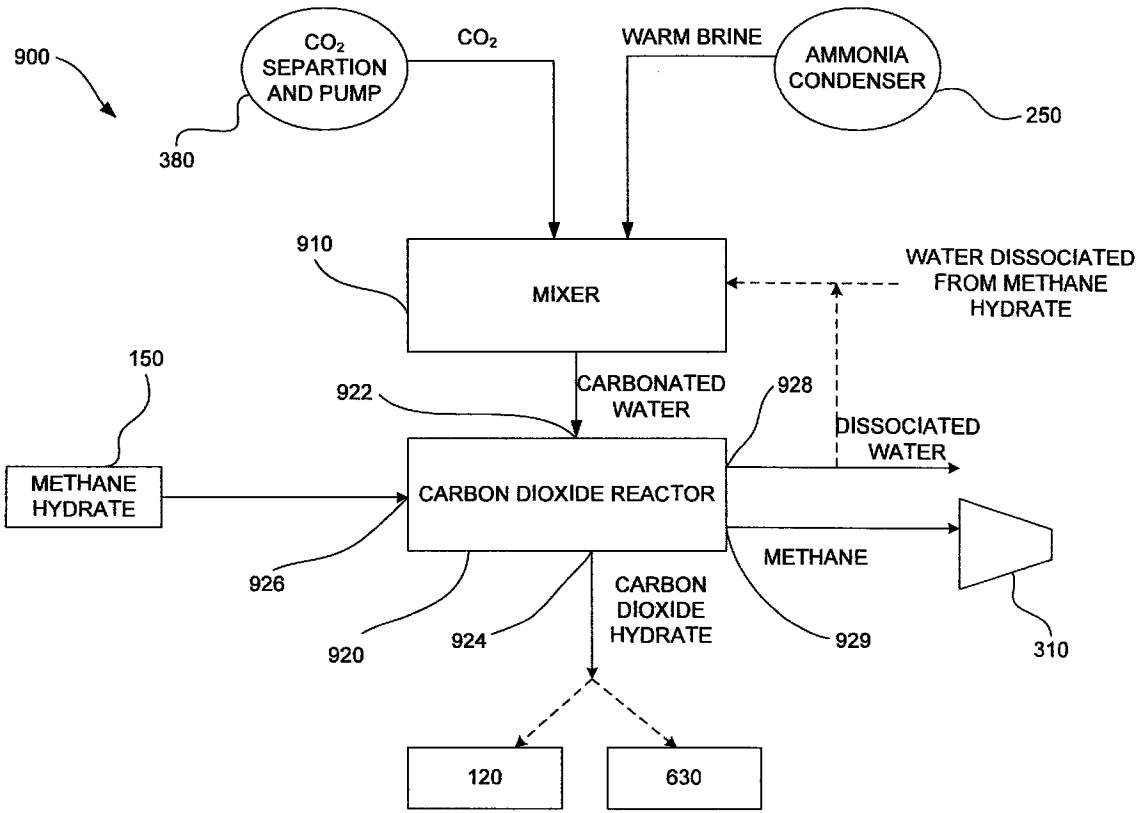
FIG. 9 is a schematic diagram of a system for reducing the emission of carbon dioxide from the power generation system of FIG. 3 by sequestering carbon dioxide hydrate, according to an embodiment of the invention.

Referring to FIG. 9, a system 900 for reducing carbon dioxide emissions from power generation system 300 of FIG. 3 is schematically illustrated, according to an embodiment of the invention. In an exemplary embodiment, system 300 may further include a carbon dioxide separation module 380 for separating carbon dioxide from the exhaust gases. Techniques and equipment for separating carbon dioxide from exhaust gases are known in the art and, therefore, are not described in further detail for the sake of brevity. According to an embodiment of the invention, carbon dioxide thus separated from the exhaust gases may be delivered to carbon dioxide bioreactor 630 (of FIG. 6) to feed the methanogens therein. In an exemplary configuration, a pressurized descender pipe (not shown) and a pump (not shown) may be used to deliver carbon dioxide from platform 160 (of FIG. 1) to bioreactor 630 (of FIG. 6). Carbon dioxide in the pressurized descender pipe (not shown) may be sufficiently pressurized by the pump (not shown) to form a condensate. Once the condensate reaches a given depth, the ambient hydrostatic pressure may be sufficient to maintain the carbon dioxide in the condensate form and external pumping is no longer needed. From that given depth, a hose may be used to deliver the carbon dioxide condensate to bioreactor 630 (of FIG. 6).

According to another embodiment of the invention, the carbon dioxide separated from the exhaust gases may be converted to carbon dioxide hydrate and then transported either to the bed of water body or bioreactor 630 (of FIG. 6). In an exemplary embodiment, a carbon dioxide hydrate reactor 920, generally similar to reactor 245 (of FIG. 5) may be used to form carbon dioxide hydrates from the carbon dioxide separated from the exhaust gases. Conveying carbon dioxide hydrates is more cost effective and requires less energy as compared to conveying carbon dioxide in a gaseous form because carbon dioxide hydrates have higher specific density compared to water and, therefore, descend into the water body without any need for pumping via a hose (not shown). One of the following two approaches may be used, depending on the size of power generation system 300.

In an exemplary configuration for large power systems producing more than 500 kilowatts, the carbon dioxide separated from the exhaust gases may be circulated through relatively warm brine ejected from ammonia condenser 250 in a mixer 910. As set forth above, the brine entering ammonia condenser 250 (of FIG. 3) is the brine conveyed along with the hydrates via conduit 150 (of FIG. 2). The brine conveyed through conduit 150 (of FIG. 2) has relatively lower concentrations of carbon dioxide because a substantial quantity of carbon dioxide has been filtered out by filter 235 (of FIG. 2) and conveyed to carbon dioxide hydrate reactor 245 (of FIG. 2). Therefore, when the carbon dioxide from the exhaust gases is circulated through relatively warm brine ejected by ammonia condenser 250 in mixer 910, substantial quantity of the carbon dioxide is absorbed by the relatively warm brine.

In another configuration for modest power systems producing less than 500 kilowatts, the carbon dioxide separated from the exhaust gases may be circulated through the generally desalinated water, also substantially fee of carbon dioxide, released by melting of the methane hydrate. It may be desirable to absorb more carbon dioxide and to compensate for the limited amounts of desalinated water by melting the methane hydrate; other types of water condensation may be added, such as the condensate from the water vapor at the many heat exchangers in system 300. Either way, carbonated water is obtained which may be used to form a slurry containing carbon dioxide hydrate using carbon dioxide hydrate reactor 920, as set forth below.

The carbonated water is directed to a first inlet 922 of reactor 920. A portion of the methane hydrate slurry conveyed through conduit 150 may be directed to a second inlet 926 of reactor 920. Generally, the temperature of the carbonated water will be higher than the temperature of methane hydrate slurry because the carbon dioxide has been extracted from the exhaust gases whereas the methane hydrate slurry is has been conveyed from the depths of the water body. As a result, heat transfer will occur from the carbonated water to the methane hydrate slurry in reactor 920. Such a heat transfer causes melting or dissociating of methane hydrate, thereby releasing methane gas and water. For the configuration using desalinated water, the solid methane hydrate may first be separated from the brine water. Then the solid methane hydrate may be melted in carbon dioxide hydrate reactor 920. Using the desalinated water reduces the clathrate association pressure by around five (5) atmospheres (see FIG. 10). This lower pressure reduces a constant parasitic power loss in power generation system 300. For both configurations, the released methane gas may be discharged at a first outlet 929. In one configuration, the released methane gas may be directed to turbine 310 for power generation. The released water may be discharged at a second outlet 928 and may optionally be directed to mixer 910.

As is known in the art, methane hydrate and carbon dioxide hydrates are Type I hydrate and have almost similar latent heats of fusion. The latent heat released by melting of methane hydrate may be used for formation of carbon dioxide clathrate. The melting of methane clathrate and the formation of carbon dioxide clathrate may be achieved at moderate pressures.

Figure 10:
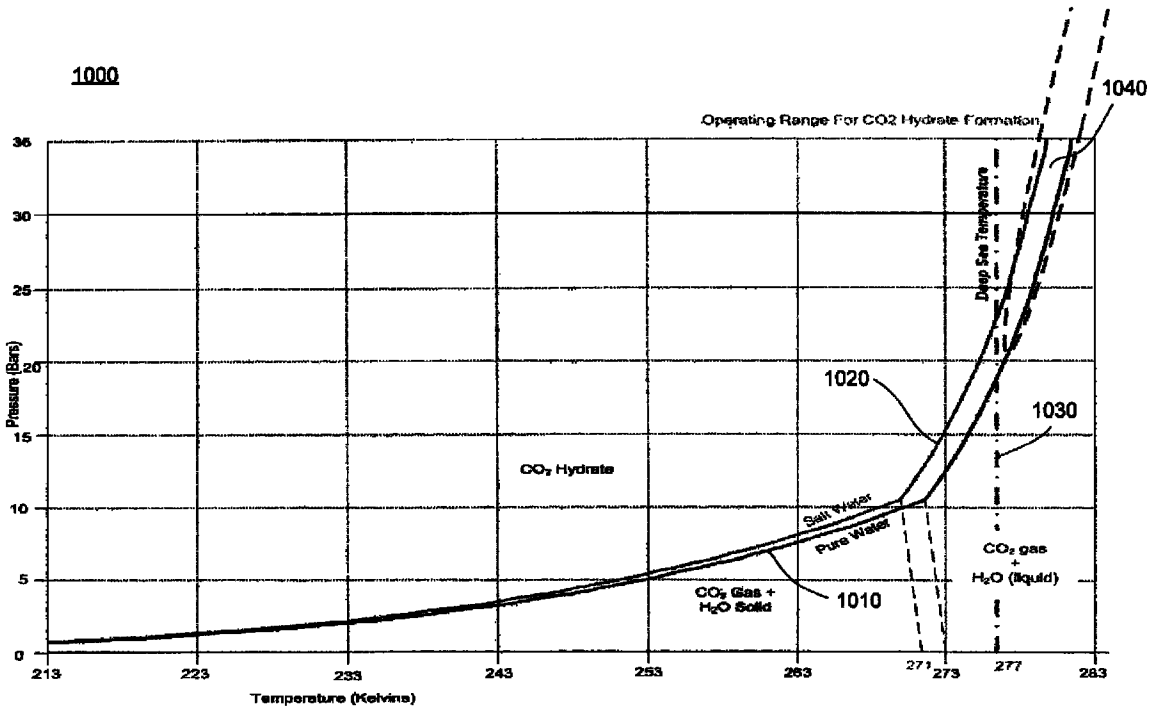
FIG. 10 illustrates carbon dioxide hydrate stability curves as functions of temperature and pressure for calculation of association and dissociation temperatures and pressures for carbon dioxide hydrates.

Referring to FIG. 10, a method for calculating association and dissociation temperatures and pressures is disclosed, according to an exemplary embodiment of the invention. The hydrate temperature and pressure calculations may be performed using the hydrate stability curves for the carbon dioxide hydrates and methane hydrates. As is known in the art, the clathrate hydrate association/dissociation pressures depend primarily on the temperature. As these hydrate stability curves are affected by saltwater, a curve 1020 for saltwater may be approximated by shifting a curve 1010 for pure water by about 2 degrees Kelvin for average seawater salinity, according to an embodiment of the invention. The dissociation parameters of the hydrate may be calculated with pure water curve 1010 because the water in hydrates is essentially purified. The association parameters of the clathrate hydrate are bounded between two curves 1010, 1020, as shown by a region 1040.

FIG. 10 illustrates the stability curves 1010, 1020 for carbon dioxide hydrate. Three phases are shown on graph 1000: carbon dioxide hydrate, carbon dioxide gas and liquid water, and carbon dioxide gas and ice. The minimum deep sea temperature is illustrated as a vertical line 1030 at 277 degrees Kelvin. The intersection of line 1030 with hydrate stability curves 1010, 1020 is of particular interest for the association and dissociation temperature and pressure calculations. The operating temperature of a hydrate reactor will be a few degrees above the deep sea temperature due to the limitations of practical heat transfer; the lower bound is around 279 degrees Kelvin. Practical hydrate reactors operate above this temperature. On surface platform 160, hydrate reactors may operate at pressures below forty-five (45) Bars. For carbon dioxide hydrate reactor 920 on surface platform 160, the minimum theoretical pressure is around twenty-one (21) bars for desalinated water, and around twenty-six (26) bars for salinated water at about 279 degrees Kelvin. For dissociating methane hydrate on surface platform 160, reactor 920 may be operated at around 1 atmosphere since methane hydrate readily absorbs heat well below the carbon dioxide hydrate association temperature of 279 degrees Kelvin. It will be appreciated that the pressures required for the formation of carbon dioxide hydrate are less than those required to maintain condensation of carbon dioxide. A slurry containing carbon dioxide hydrate is discharged at a third outlet 924 of reactor 920. Since carbon dioxide hydrate is denser than the surrounding water, the slurry containing carbon dioxide hydrate tends to sink naturally in the water body.

In one configuration, the carbon dioxide hydrates may be conveyed via a hose (not shown) and deposited on bed 120, where they will stay frozen because the relatively low temperatures of the surrounding water. In another configuration, carbon dioxide hydrates may be conveyed via a hose (not shown) to carbon dioxide bioreactor 630 for feeding the methanogens contained therein. As is known in the art, carbon dioxide is a desirable nutrient feed for the methanogens. In yet other configuration, an adjustable remotely controlled valve (not shown) may be used to regulate the amount of the carbon dioxide hydrates entering bioreactor 630 and to discharge the excess carbon dioxide hydrates onto bed 120. The amount of carbon dioxide hydrates entering bioreactor 630 may be regulated based on carbon dioxide and hydrogen sulfide concentrations in the underwater plumes, which may be measured using known sensors (not shown).

Depending on the requirements of a given application, different proportions of methane and hydrogen may be produced in bioreactors 610, 630 by reducing the molecules of hydrogen sulfide and carbon dioxide in appropriate proportions. For instance, in an exemplary configuration, one (1) molecule of carbon dioxide and four (4) molecules of hydrogen sulfide may be reduced to produce one (1) molecule of methane as shown in Table 1 above. In another configuration, seven (7) molecules of carbon dioxide and thirty-one (31) molecules of hydrogen sulfide may be reduced to produce seven (7) molecules of methane and three (3) molecules of hydrogen as shown in Table 2 above. The methanogens also consume carbon dioxide to build their cellulosic structures and organics. Thus, the deficiency of carbon dioxide, if any, in the underwater plumes may be compensated by adding carbon dioxide hydrates as described above. The carbon dioxide hydrates melt when in contact with relatively hot plume water, thereby releasing carbon dioxide gas in bioreactor 630, which gas may then be consumed by the methanogens as an energy source.

Method for Harvesting Potable Water

As is known in the art, when water freezes around hydrogen and methane molecules to form methane hydrate and hydrogen-methane hydrate, the salt and other solutes in the water are separated and substantially pure water is frozen in the hydrates. When the hydrates are brought to the surface of the water and liquefied to release methane and hydrogen respectively, the water released therefrom is substantially pure, i.e., free of salt and other minerals generally present in seawater. Thus, an advantageous by-product of the methane hydrate and hydrogen-methane hydrate harvesting process described herein is the release of potable water.

While the foregoing invention has been described with reference to the above-described embodiment, various modifications and changes can be made without departing from the spirit of the invention. Accordingly, all such modifications and changes are considered to be within the scope of the appended claims. Accordingly, the specification and the drawings are to be regarded in an illustrative rather than a restrictive sense. The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations of variations of various embodiments. Combinations of the above embodiments, and other embodiments not specifically described herein, will be apparent to those of skill in the art upon reviewing the above description.

What is claimed is:

1. A method for extracting a gas from an underwater plume comprising the steps of:

receiving at a first inlet of a first underwater heat exchanger in a water body, a first fluid containing water and at least one gas capable of forming a clathrate hydrate;

receiving at a second inlet of said first underwater heat exchanger, an ambient second fluid, said ambient second fluid being at a temperature sufficiently lower than the temperature of said first fluid to cause a transfer of sufficient heat therebetween to form a clathrate hydrate in said first fluid; and discharging at a first outlet of said first underwater heat exchanger a slurry containing said clathrate hydrate.

2. The method of claim 1, wherein said at least one gas comprises methane, hydrogen or carbon dioxide, and wherein said clathrate hydrate comprises at least one of methane hydrate, hydrogen-methane hydrate and carbon dioxide hydrate.

3. The method of claim 1, further comprising a step of conveying said clathrate hydrate to the surface of the water body via a duct connected to said first outlet of said first underwater heat exchanger, if said clathrate hydrate comprises either methane hydrate or hydrogen-methane hydrate.

4. The method of claim 1, further comprising a step of releasing said clathrate hydrate through said first outlet of said first underwater heat exchanger into the water body, thereby causing said clathrate hydrate to be deposited on the bed of the water body, if said clathrate hydrate comprises carbon dioxide hydrate.

5. The method of claim 1, further comprising a step of collecting via an underwater plume collector, an underwater plume emitted from a hydrothermal vent, said underwater plume including at least methane and hydrogen.

6. The method of claim 5, further comprising a step of filtering said underwater plume to extract at least hydrogen, methane and brine prior to the step of receiving at the first inlet of said first underwater heat exchanger the first fluid.

7. The method of claim 5, further comprising a step of filtering said underwater plume to extract carbon dioxide and brine prior to the step of receiving at the first inlet of said first underwater heat exchanger the first fluid.

8. The method of claim 5, wherein said underwater plume collector is suspended overhead an anaerobic aquaculture surrounding the hydrothermal vent, thereby further collecting methane released by microorganisms residing in the anaerobic aquaculture.

9. The method of claim 1, further comprising a step of heating said clathrate hydrate, if said clathrate hydrate comprises methane hydrate or hydrogen-methane hydrate, thereby causing said clathrate hydrate to decompose into one or more of methane, hydrogen, and water, wherein said water is substantially free of salts generally present in the water.

10. The method of claim 9, further comprising the step of receiving said decomposed water at a first inlet of an ammonia condenser, said decomposed water being at a temperature sufficiently lower than a temperature of ammonia entering said ammonia condenser from an ammonia turbine, wherein a transfer of heat from said ammonia to said decomposed water causes condensation of said ammonia.

11. The method of claim 10, further comprising the step of pumping said condensed ammonia from said ammonia condenser to an ammonia evaporator, said ammonia evaporator receiving steam from a steam turbine, said steam being at a temperature sufficiently higher than a temperature of said condensed ammonia, wherein a transfer of heat from said steam to said ammonia causes evaporation of said ammonia and condensation of said steam to water.

12. The method of claim 11, comprising the steps of:

pumping said water discharged by said ammonia evaporator to a water evaporator, said water evaporator receiving exhaust gases from a gas turbine, said exhaust gases being a temperature sufficiently high to evaporate said water to form steam; and feeding said steam to said steam turbine.

13. The method of claim 11, further comprising the steps of: superheating said evaporated ammonia in an ammonia superheater, said ammonia superheater receiving exhaust gases from a gas turbine, said exhaust gases being at a temperature sufficiently higher than a temperature of said evaporated ammonia, wherein a transfer of heat from said exhaust gases to said evaporated ammonia causes superheating of said evaporated ammonia; and feeding said superheated ammonia to said ammonia turbine.

14. The method of claim 1, further comprising the step of receiving at an underwater bioreactor substantially adjacent to said first underwater heat exchanger and in vicinity of a hydrothermal vent, a third fluid containing at least seawater and gases emitted by a hydrothermal vent, wherein said gases comprise one or more of hydrogen, methane and carbon dioxide, and wherein said underwater bioreactor contains at least methanobacteria adapted to consume carbon dioxide and to release methane, thereby forming said first fluid prior to the step of said first fluid being received at said first inlet of said first underwater heat exchanger.

15. A method for extracting fuel gases from a underwater plume emitted from an underwater hydrothermal vent, the method comprising the steps of:

collecting via an underwater plume collector in a water body, an underwater plume emitted from the hydrothermal vent, said underwater plume including methane and hydrogen;

directing a first fluid containing the underwater plume into a first inlet of a first underwater heat exchanger; and a second fluid into a second inlet of said first underwater heat exchanger, said second fluid at the second inlet being at a temperature sufficiently lower than the temperature of said first fluid, to transfer sufficient heat therebetween to form at least one of methane hydrate and hydrogen-methane hydrate from said first fluid; and conveying said at least one of methane hydrate and hydrogen-methane hydrate to the surface of the water body via a duct connected to a first outlet of said first underwater heat exchanger.

16. The method of claim 15, wherein the step of directing the first fluid further comprises a step of osmotically filtering said emissions to extract hydrogen and methane.

17. The method of claim 15, further comprising a step of heating said at least one of methane hydrate and said hydrogen-methane hydrates, thereby causing said hydrates to decompose into one or more of methane, hydrogen, and water, wherein said water is substantially free of salts generally present in the water.

18. The method of claim 15, wherein said underwater plume collector is suspended overhead an anaerobic aquaculture surrounding the hydrothermal vent, thereby further collecting methane released by microorganisms residing in the anaerobic aquaculture.

19. The method of claim 15, wherein said underwater plume further comprise carbon dioxide, said method further comprising the steps of:

directing a second fluid comprising the water and carbon dioxide into a first inlet of a second heat exchanger located substantially adjacent to said underwater plume collector;

directing ambient water into a second inlet of said second heat exchanger, said ambient water being at a temperature lower than the temperature of said second fluid, thereby causing said water to sufficiently cool said second fluid via heat transfer therebetween to cause the formation of carbon dioxide hydrate; and releasing said carbon dioxide hydrate through a first outlet of said second heat exchanger into the water body, thereby causing said carbon dioxide hydrate to be deposited on the bed of the water body.

20. The method of claim 19, wherein the step of directing a second fluid further comprises a step of osmotically filtering said underwater plume to extract carbon dioxide.

21. A method for generating methane hydrate using microorganisms comprising:

receiving a first fluid containing at least water and gases emitted by a hydrothermal vent, at an underwater bioreactor in vicinity of the hydrothermal vent, said gases comprising one or more of hydrogen, methane and carbon dioxide, and said underwater bioreactor containing at least methanobacteria adapted to consume carbon dioxide and to release methane;

receiving said first fluid from said underwater bioreactor at a first inlet of an underwater heat exchanger located substantially adjacent to said underwater bioreactor;

directing ambient water into a second inlet of said underwater heat exchanger, said ambient water being at a temperature sufficiently lower than the temperature of said first fluid, thereby causing said water to cool said first fluid sufficiently to cause the formation of at least one of methane hydrate and hydrogen-methane hydrate; and conveying said at least one of methane hydrate and hydrogen-methane hydrate through a duct connected to a first outlet of said first heat exchanger, at least partially due to increased buoyancy of said hydrates to the surface of the water body.

22. A system for harvesting gases from an underwater vent comprising:

a plume collector positioned above a hydrothermal vent in a water body bed for collecting plumes emitted by the hydrothermal vent, said plumes containing at least one gas capable of forming a clathrate hydrate; and a first underwater heat exchanger in fluid communication with said plume collector positioned in general vicinity of the water body bed, said first underwater heat exchanger comprising:

a first inlet configured to receive a first fluid containing said plumes collected by said plume collector;

a second inlet configured to receive ambient water at a temperature sufficiently lower than a temperature of said first fluid to cause a transfer of heat therebetween to cause formation of a clathrate hydrate in said first fluid;

a first outlet for ejecting a slurry containing said clathrate hydrate; and a second outlet for ejecting the water.

23. The system of claim 22, further comprising:

a filter in fluid communication with said plume collector, said filter configured to divide the plumes collected by said plume collector into at least a first stream containing at least methane, hydrogen and brine and a second stream containing at least carbon dioxide and brine; and a second underwater heat exchanger positioned in general vicinity of the water body bed and in fluid communication with said filter, said second underwater heat exchanger comprising:

a first inlet configured to receive said second stream;

a second inlet configured to receive ambient water at a temperature sufficiently lower than a temperature of said second stream to cause a transfer of heat therebetween to cause formation of carbon dioxide hydrate in said second stream;

a first outlet ejecting the carbon dioxide hydrate into the water body; and a second outlet for ejecting the ambient water; and a riser pipe for conveying the slurry containing clathrate hydrate to the surface of the water body, wherein said first stream from said filter is received at said first inlet of said first underwater heat exchanger.

24. A system for generating clathrate hydrate using microorganisms comprising:

a hydrogen-sulfide bioreactor configured to receive at least hydrogen sulfide from a hydrothermal vent and containing at least sulfur reducing bacteria for consuming hydrogen sulfide and releasing hydrogen and sulfur;

a carbon dioxide bioreactor configured to receive at least carbon dioxide from at least said hydrogen sulfide bioreactor and containing at least methanobacteria for consuming carbon dioxide and releasing methane;

an underwater heat exchanger in fluid communication with said carbon dioxide bioreactor for receiving a first fluid containing at least hydrogen, methane and brine, said underwater heat exchanger comprising:

a first inlet configured to receive said first fluid;

a second inlet configured to receive ambient water at a temperature sufficiently lower than a temperature of said first fluid to cause heat transfer therebetween, thereby causing formation of a clathrate hydrate in said first fluid;

a first outlet for ejecting a slurry containing said clathrate hydrate; and a second outlet for ejecting said ambient water.

25. The system of claim 24, further comprising a filter in fluid communication with said hydrogen sulfide bioreactor configured for directing a stream containing hydrogen, carbon dioxide and brine from said hydrogen sulfide bioreactor to said carbon dioxide bioreactor and for confining sulfur reducing bacteria to said hydrogen sulfide bioreactor.

26. The system of claim 24, further comprising a filter in fluid communication with said carbon dioxide bioreactor and configured for directing a stream containing methane, hydrogen and brine from said carbon dioxide bioreactor to said underwater heat exchanger and for confining said methanobacteria to said carbon dioxide bioreactor.

27. The method of claim 1, wherein the first underwater heat exchanger is configured to isolate the first fluid and the ambient second fluid such that mixing is prevented therebetween.

* * * * *